United States Patent [19]

Bonink

[11] 4,330,970

[45] May 25, 1982

[54] BUILDING STRUCTURE AND STEEL PARTS FOR SAME

[75] Inventor: Johannes A. Bonink, Nederhorst den Berg, Netherlands

[73] Assignee: Copreal S.A., Fribourg, Switzerland

[21] Appl. No.: 87,564

[22] Filed: Oct. 23, 1979

[51] Int. Cl.[3] ..... E04H 1/00; E04B 1/00; E04C 3/26

[52] U.S. Cl. ..... 52/125; 52/223 R; 52/235; 52/236.7; 52/236.8; 52/251; 52/263; 52/283; 52/292

[58] Field of Search ..... 52/236.7, 236.8, 251–253, 52/263, 583, 726, 722, 223 R, 235, 283, 587, 125, 292

[56] References Cited

U.S. PATENT DOCUMENTS

| | | | |
|---|---|---|---|
| 1,380,324 | 5/1921 | Piggins | 52/236.7 X |
| 1,472,897 | 11/1923 | Anderson | 52/731 |
| 1,796,048 | 3/1931 | Robinson | 52/283 X |
| 2,587,724 | 7/1952 | Henderson . | |
| 3,036,356 | 5/1962 | Graulich | 52/223 R |
| 3,110,982 | 11/1963 | Besinger | 52/283 X |
| 3,261,135 | 7/1966 | Knabe | 52/252 X |
| 3,378,971 | 4/1968 | Singer et al. | 52/236.7 X |
| 3,495,371 | 2/1970 | Mitchell, Jr. | 52/236.7 X |
| 3,585,771 | 6/1971 | Pinniger | 52/251 |
| 3,594,971 | 7/1971 | Hughes | 52/236.7 |
| 3,983,673 | 10/1976 | Camus | 52/263 |

FOREIGN PATENT DOCUMENTS

| | | | |
|---|---|---|---|
| 778542 | 2/1968 | Canada | 52/236.7 |
| 1243596 | 6/1967 | Fed. Rep. of Germany | 52/726 |
| 2427194 | 1/1975 | Fed. Rep. of Germany | 52/223 |
| 2442941 | 3/1976 | Fed. Rep. of Germany | 52/263 |
| 1311981 | 10/1962 | France . | |
| 7209390 | 6/1974 | Netherlands . | |
| 462418 | 10/1968 | Switzerland | 52/236.7 |
| 1246178 | 7/1971 | United Kingdom . | |

OTHER PUBLICATIONS

Report No. B-78-426, Blad. No. 14, Dutch Institute for Applied Research . . . Building Construction, 1978.

Guides to Good Practice, 1975, FIP/CEB Recommendations, published by Federation Internationale de la Precontrainte.

Cement XXVIII (1976) No. 9, pp. 380+, by Koemans et al.

*Primary Examiner*—Alfred C. Perham

*Attorney, Agent, or Firm*—Cushman, Darby & Cushman

[57] ABSTRACT

A building structure whose frame, consisting of prefabricated parts or pieces, is formed by a number of elements in the form of slabs (floor or ceiling elements) arranged one above the other and connected to one another by support columns at the corners of the elements, with tubular sections transmitting both the weight of the elements to the columns and the forces exerted by columns aligned with each other, and a steel structure for use in such a building structure.

20 Claims, 9 Drawing Figures

BUILDING STRUCTURE AND STEEL PARTS FOR SAME

The invention relates to a building structure the frame of which, composed of prefabricated parts, consists of a number of slabshaped elements (floor or roof elements) arranged one above the other, which are connected by support columns fixed at the corners of the elements in tubular sections which both transmit the weight of the elements to the columns and pass on the forces exerted by columns aligned with each other. The slab-shaped floor or roof elements or slabs will be referred to henceforth as "elements"; the tubular sections may be circular or rectangular in cross-section. The invention also relates to a steel structure for use in the said building structure.

The principle of a building structure of the kind specified above is mentioned in Netherlands Patent Application No. 7209390. An objection to the structure described therein is that all forces are transmitted via fixation sections attached externally to the elements. In order to ensure a sound load-carrying construction the corner points are interconnected by a support frame of U-section sheet-steel material. Although the version shown may be dimensionally stable, it is unsuitable for being constructed entirely in concrete. A further disadvantage is that the structure described is not very suitable for use in combination with fire-resistant columns other than steel columns. The structure described has the further disadvantage that where two or more elements meet, more or less complicated, or at any rate composite columns are needed; see in particular FIGS. 3–8 of the said application.

A building structure in which this last objection is eliminated and four corners of four meeting slab-shaped elements in each case rest on a single column is described in Netherlands Patent Application No. 6903098. The elements (floor surfaces) are formed by slabs (20) which as in the aforesaid structure are formed by beams (22) forming pairs of projecting trestles (23) in the corner areas of the said slabs. These trestles form supports for the elements resting on the columns. They have drilled passages (24) through which threaded rods (17) embedded in one end during prefabrication of the columns can mate with corresponding recesses (18) in the bottom of the next column. It will immediately be clear that the weight of the elements in a "concrete-on-concrete" contact is transmitted to the columns and the forces exerted on the next column are transmitted via this connection. If the support structure shown is used to support relatively large elements. (e.g. 2.40×7.20 m) on relatively slim columns (e.g. measuring 20×20 cm) this support will yield under the effect of a number of forces. In the next favourable case, there is no sufficiently large safety factor by which these forces can be exceeded. The forces occuring are:

a. a transverse force due to dead weight, permanent load, variable load and a support reaction as a result of tolerances in support levels; particularly the last factor has an unfavourable effect in the structure according to Netherlands Patent Application No. 6903098;

b. the horizontal tensile force to be expected as a result of wind load, misalignment and second-order displacements;

c. the effect which the vertical loading by the columns carrying the lower floors has on the level of the clamping moment.

It has been stated by the TNO* Institute of Building Materials and Building Structures that the support structure will only be satisfactory if the forces described above can be exceeded by a factor 1.7 before the connection yields. Finally, the dimensional stability of the construction shown will not be great, as a result of the cumulation of dimensional deviations in column length and floor thickness.

*Dutch Applied Technical Research Organisation

U.S. Pat. No. 2,587,724 shows a structure with two concrete beams on the top of a concrete column. The reinforcement of the column projects beyond the top end and is enclosed by pipes incorporated at right angles in the ends of the beams and anchored in them. It is possible in this way to absorb horizontal tensile forces acting between the beams via the anchored pipes and the projecting reinforcing bars. FR-A 1,311 931 shows that reinforcing bars can be inserted in pipes and fixed in them by filling with grout.

The general objective of the invention is to provide a building structure consisting of concrete parts which:

1. is suitable for prefabrication and rapid assembly and thus humanises work in that a water- and wind-proof structure is exerted rapidly;
2. is nevertheless of high quality and is therefore suitable for use in buildings of large size;
3. uses concrete columns whose cross-section if not greater than that required in order to comply with fire safety standards;
4. ensures a dimensional stability of the same order as that of steel structures;
5. at the same time makes possible construction of a great variety of buildings using standard concrete parts; and
6. can, additionally, be disassembled and re-assembled.

More particularly, the object is to provide a building structure as specified in the preamble, in which the corners of the elements and the ends of the columns are provided with simple means for safely absorbing the occuring forces in such a manner that the general objectives can be met.

The invention, therefore, relates to a building structure whose frame, composed of prefabricated parts, consists of a number of slab-shaped elements located one above the other and connected by support columns which are fixed at the corners of the elements in tubular sections which both transmit the weight of the elements to the columns and pass on the forces exerted by columns aligned with each other. The invention differs from this state of the art as specified in NL-A 7209390 by the following features:

a. the concrete support columns are fitted at the top end with a head or cover plate and with at least one bar projecting axially from this end;

b. the tubular sections are so embedded at the corners of the elements and the protruding bars are so positioned at the end of the columns that in the assembled condition a corner of an element covers approximately one quadrant of the head of a column while the tubular sections extend at least to the top and bottom surfaces of the elements;

c. the ratio of the inside diameter of the pipe (pipes) of the diameter of the bar (bars) is 3:2 to 5:2.

More particularly:

a. the concrete columns are fitted at both ends with steel head-plates containing holes which clamp round the projecting bars embedded in the columns;
b. the tubular sections at the corners of the elements are composed of:
   (i) a first angle iron which forms the corner and does not protrude beyond the imaginary extension of the edge of the element;
   (ii) a second angle iron welded against the inside of the first, so as to create a tubular opening the diameter of whose inscribed circle is to the diameter of the mating bar as 3:2 to 5:2;
c. the edges of the elements which are reinforced with prestressed bars fastened to the flanges of the first angle iron with a nut connection.

Additionally, to take up transverse forces resulting from vertical loads:

a. the tubular section or the two angle irons at the side forming the bottom of the element has (have) welded to it (them) a base plate whose dimensions are at least equal to those of the flanges of the first angle iron and which has an aperture corresponding to that between the first and second angle irons;
b. the combined height of the tubular section of angle irons and the base plate at a corner is equal to the thickness of the elements at that corner.

Further reasons for designing the structure in accordance with the invention are the following:

The European FIP/CEB Committee has made recommendations for uniform international rules on the point of reinforced and prestressed concrete in "Guides to good practice", dated June 1975. For a fire-resistance of 60 minutes, column dimensions of at least 20×20 cm and a thickness of 8 cm for the floor slabs are recommended. These recommendations may be expected to be made mandatory in codes of practice for concrete applications in the Netherlands and other European countries within a few years. Therefore, the above dimensions have been chosen as possible minima.

The support for four adjoining corners of elements has to be effected on a single concrete column of only 20×20 cm cross-section, because with individual columns for each corner composite columns measuring at least 42×42 cm are obtained. Support on a single concrete column means that a supporting surface of only 10×10 cm is available for every corner of an element, so that steel aids are needed to transmit the supporting forces. Now that steel aids are necessary anyhow, an effort has been made to derive a number of advantages from the same quantity of steel, and this has led to the structure described above. It is now also possible to fix the concrete elements in position on the concrete columns during erection by providing the steel aids with dowels and mortises, but sufficient clearance must be left between a dowel and a mortise to cope with the lengthwise and cross-wise dimensional tolerances of the concrete elements, so that the dimensional stability finally obtained is of the same order as that of steel structures.

When concrete slabs are supported at their corners it appears necessary to strengthen the edges with steel sections covering the whole length of each edge, as indicated in Netherlands Patent Application No. 7209390. The application of high-quality tensioning bars in an element in combination with soft-steel sections leads to an economically unjustified quantity of steel being used and consequently a constructional solution has been sought in which the high-quality tensioning bars are used also as edge reinforcement. A condition of such use is that these tensioning bars be reliably connected to the supporting steel structure at the corners of the elements. As a result of the use of angle irons the possibility has been created to lead the tensioning bars through the flanges of the angle irons and to lock them in position by tightening nuts on the threaded ends of the tensioning bars after pretensioning. The corner structure and the edge reinforcement thus form a single functional whole.

Since the tensile force in the tensioning bars is situated eccentrically in relation to the external horizontal force through the centre of the hollow space between the angle irons, it is necessary to overcome this eccentricity by using two embedded reinforcing rods of approximately circular section, each of which is welded to a flange of the first angle iron. These two rods may form a single loop.

The concrete columns, when they support four corners, are provided with steel head plates measuring, for example, 160×160×10 mm, with four 20 mm diameter holes. Bars with a diameter of 20 mm and a length of 300 mm have been inserted into these holes. These bars are bevelled at their extremities to facilitate location of the elements. If the concrete columns shrink in the longitudinal direction, the steel head plates will slide over the rods and will thus continue to rest on the top surface of the concrete columns. The use of the rods means that in the factory the head plates at right angles to them can be embedded so as to be dimensionally stable by clamping the protruding ends of the rods in the formwork. In this way it is possible to obtain concrete columns of high dimensional stability with a length tolerance of ±2 mm.

The supporting pressure on the concrete slab is transmitted to the concrete column in that the embedded base plates fastened to the angle irons rest direct on the steel head plates. Although the structure consists of concrete elements, the supports thus obtained are of the "steel-on-steel" type, and have the dimensional stability inherent in this type of support.

The floor thickness between the head plates of the columns is determined exclusively and accurately by the dimensionally stable length of the steel corners, so that the design tolerance at floor level remains limited to ±2 mm, which is comparable with the tolerances in steel structures. According to an investigation into dimensional deviations in prefabricated concrete elements (Cement 28 (1976), pp. 9–12) the tolerances for a 90% probability range are normally: vertically 20 mm, in the horizontal plane 40 mm, and in the thickness of floor slabs 10 mm. The structure according to the invention can remain comfortably within these tolerances; deviations in the vertical direction will not exceed 2 mm, while those in the thickness of the floor slabs are irrelevant with the construction in question. There is no cumulation of dimensional deviations. The support reactions at the four corners of an element will therefore be practically the same, which is a great advantage of the present structure in relation to other concrete structures.

In order to fix the centre lines through two or more storeys, steel pipes are preferably slid over the pins projecting from subpositioned columns after the floor slabs have been fitted, sufficient tolerance in the longitudinal and lateral directions, for example, plus and minus 5 mm, being left. For a bar thickness of 20 mm and a 36 mm diameter opening in the fixation section, the pipe will, for example, have inside and outside diameters of 21 and 25 mm, respectively. These pipes are temporarily blocked off during assembly and fixed to each other with caps.

After the joints between the floor slabs and the hollow space between the angle irons and the said pipe have been filled with sand/cement mortar and the latter has hardened, the columns of the next storey can be placed to give a dimensionally stable structure by sliding the pins protruding at the bottom into the said pipes. The pipes will therefore have a length not greater than that of the angle irons.

When the elements are supported on columns, concentrated (point-type) loads are created on the foundations and no line-type loads occur. This means that no foundation beams are needed and the first floor can be built directly on to the pile heads or the footings. In this case it is possible to use on the pile foundations or on the footings an accessory provided with the necessary number of projecting bars and a plate, attached to an adjustable base. Actually, the top part of an installed and permanently fixed accessory corresponds to the end of a column. The fact that the elements are supported on columns and that rigid elements are used means that foundation beams can be omitted because the elements are supported exclusively at their corners.

In order that wind forces etc. may be absorbed, it will be necessary to provide at least two columns with wind bracing. Preferably, for this purpose at least two columns, in two directions, will be made in the form of stability walls by, as it were, filling the space between two columns. Bars with slabs at the (future) top and bottom will protrude at the desired spacings corresponding to the distances between columns. A plate of this kind can be used as an (intermediate) wall.

Although the columns can in principle support four elements, this cannot be the case in particular along the outside walls and at corners. The unused bars or pins and parts of support slabs can be used to advantage to suspend parts of the facing work from. Although various versions of details are possible, the principle may be characterised by stating that the parts of the outside wall at the (future) top are fitted with laterally projecting parts in which fixation apertures are incorporated whose centre distance corresponds to the distance between the corresponding fixation sections in the adjoining slab-shaped elements. In other words, if the columns and the slabs resting on them have been fixed, the parts of the facade can, without additional work, be suspended from them to give a dimensionally stable structure. The concrete elements (both floor and roof elements) can have any suitable detail design. The floor will preferably be a familiar ribbed or groined slab floor, with ribs at the underside containing prestressed reinforcement. Acoustic insulation can be fitted under the floor between the ribs.

A complete understanding of the invention may be obtained from the following description in conjunction with the figures, of which:

Figure 1:
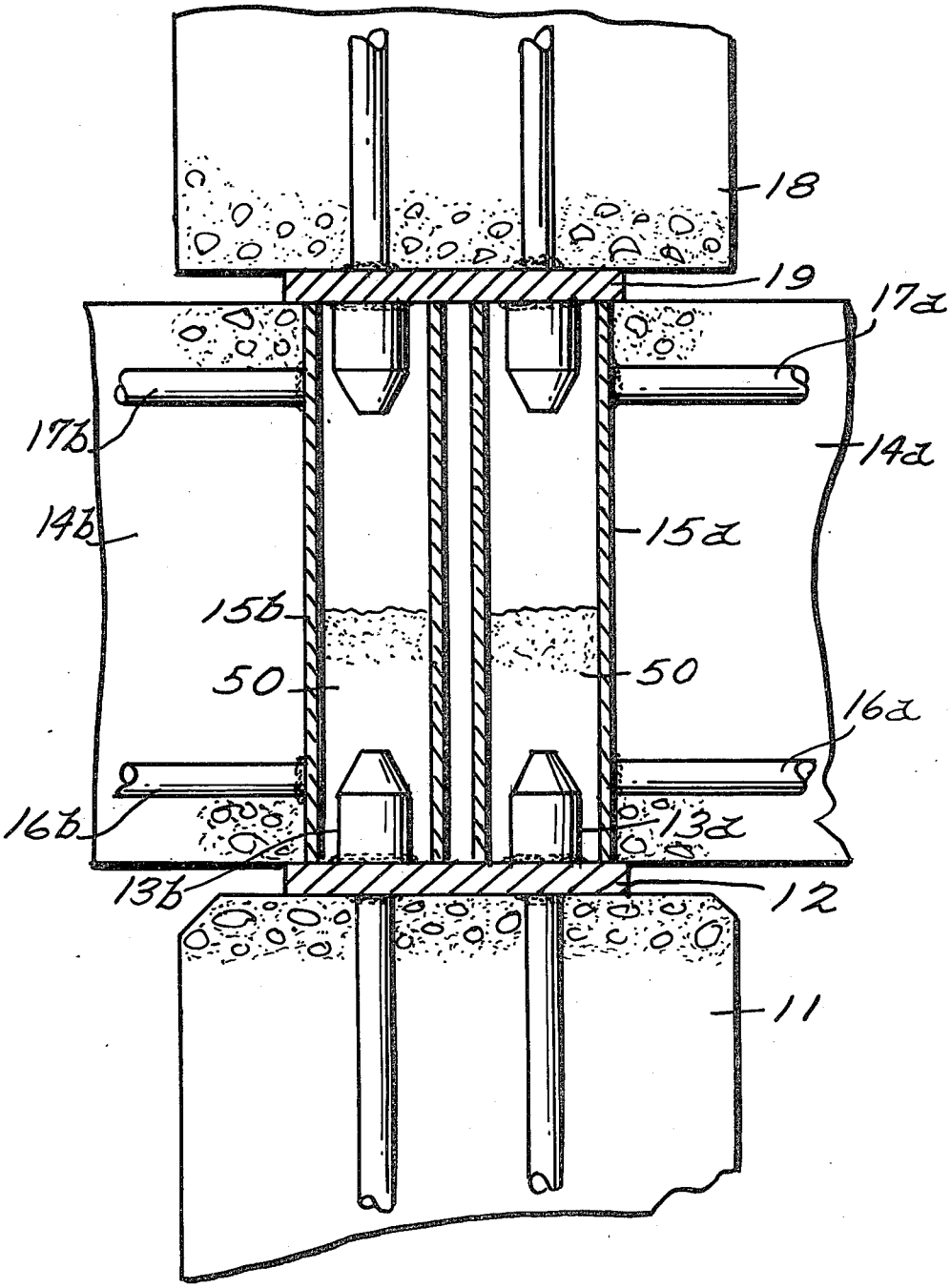
FIG. 1 is a section through two aligned upright columns and two adjoining slab-shaped concrete elements.
Figure 2:
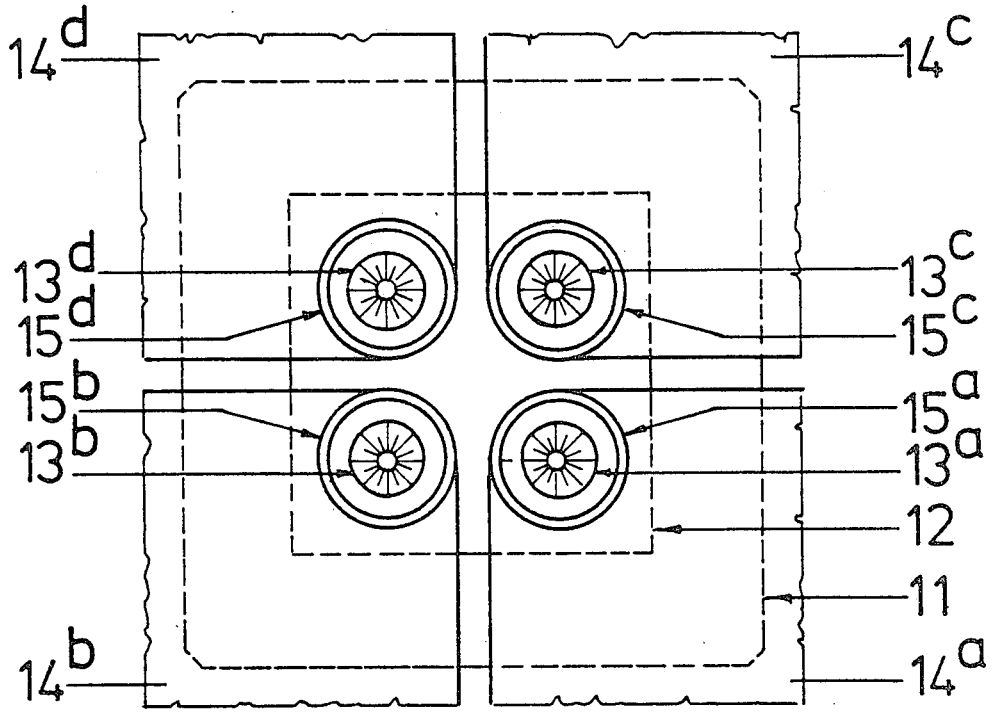
FIG. 2 is a section taken along the plane of line A—A in FIG. 1, in which four elements meet.

According to a version of the invention which is shown in FIG. 1 and FIG. 2, concrete column 11 has at its top a head plate 12 which is fitted with pins 13*a* and 13*b*. FIG. 2 additionally shows pins 13*c* and 13*d*. Near the corners of elements 14*a* and 14*b*, and those of elements 14*c* and 14*d*, tubular fixation sections 15*a* and 15*b*, and 15*c* and 15*d*, respectively, are embedded in the concrete. These are anchored by means of welded-on bars 16*a* and 16*b*, and 17*a* and 17*b*. The tubular fixation sections 15*a* through 15*d* project at most only several millimeters beyond the surface of the elements. When elements 14*a* and 14*b*, and 14*c* and 14*d*, respectively, are placed on the head of column 11, the ends of sections 15*a* through 15*d* consequently rest on plate 12. Similarly, the next column 18, which carries the next element (not shown), rests with plate 19 on the other end of sections 15*a* and 15*b* which transmit the forces. After the columns and elements have been placed in position the empty space in the fixation sections is filled with a sand/cement mortar or some other substance. This mortar is of constructional significance in so far as it renders parts which have been placed accurately together immovable in relation to one another. The centring pipes described in the following figures can also be added in this embodiment.

Figure 3:
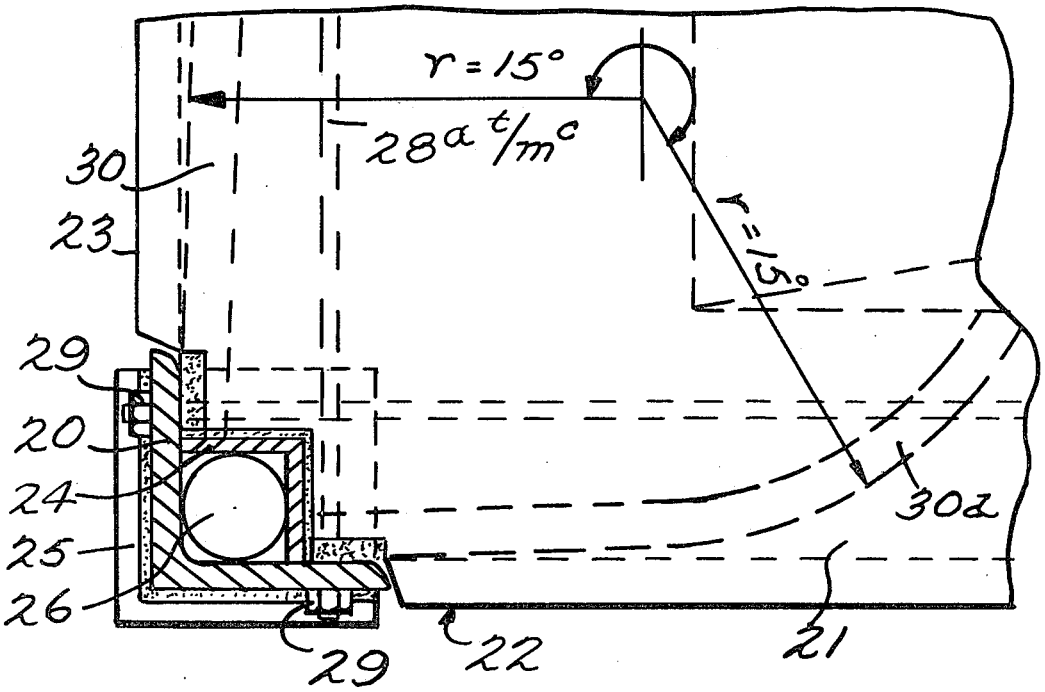
FIG. 3 is a top-view detail of the tubular corner finish in the preferred embodiment.
Figure 4:
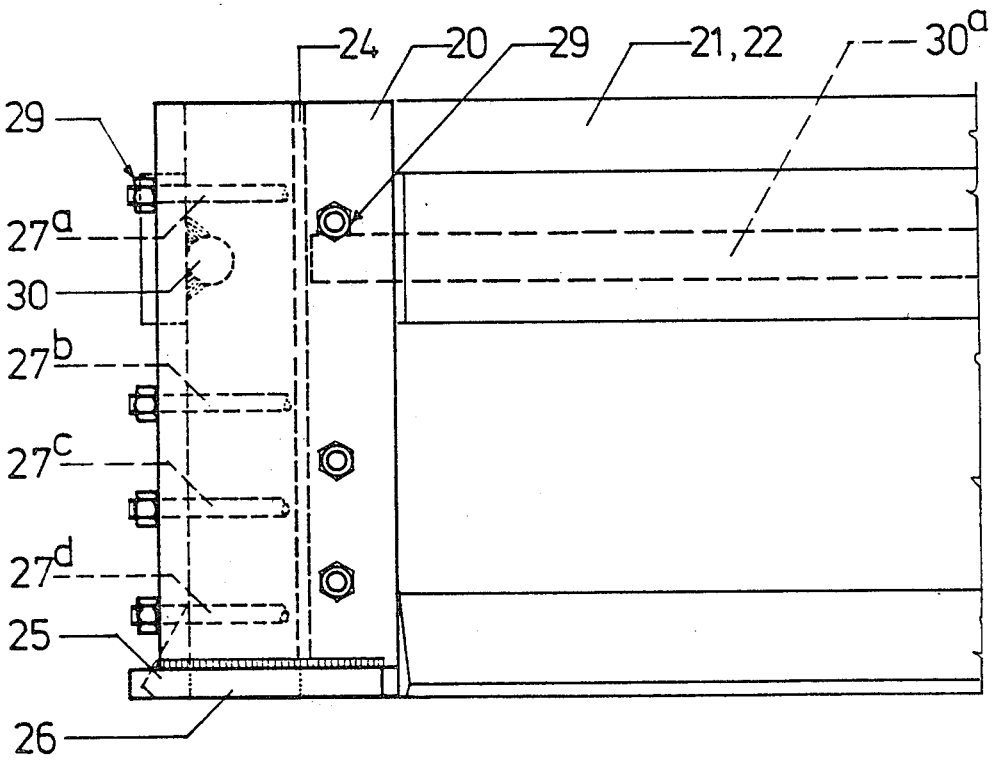
FIG. 4 shows the same detail in a side view.

FIGS. 3 and 4 show, in section and elevation, respectively, details of the preferred embodiment of the invention. The tubular section 15 shown in FIG. 1 now consists of a heavy angle iron 20, forming one of the corners of element 21 and situated within the imagined extensions of edges 22 and 23. A second, somewhat lighter, angle iron 24 is welded to the first angle iron 20 inside the latter. Both angle irons 20 and 24 are welded to a square baseplate 25, approximately of the same size as the flange of angle iron 20. A hole 26 in the baseplate 25 corresponds with the circle inscribed in the space between the two angle irons 20 and 24. Pretensioned edge reinforcing bars 27*a*, 27*b*, 27*c* and 27*d*, and 28*a*, 28*b* and 28*c*, respectively, are fastened, in pretensioned condition, to the flanges of angle iron 20 by means of nuts 29. The curved reinforcing rods 30 and 30*a*, which are welded to the flanges of angle iron 20, take up the horizontal external forces together with bars 27 and 28. These two rods can together form an arc.

Figure 5:
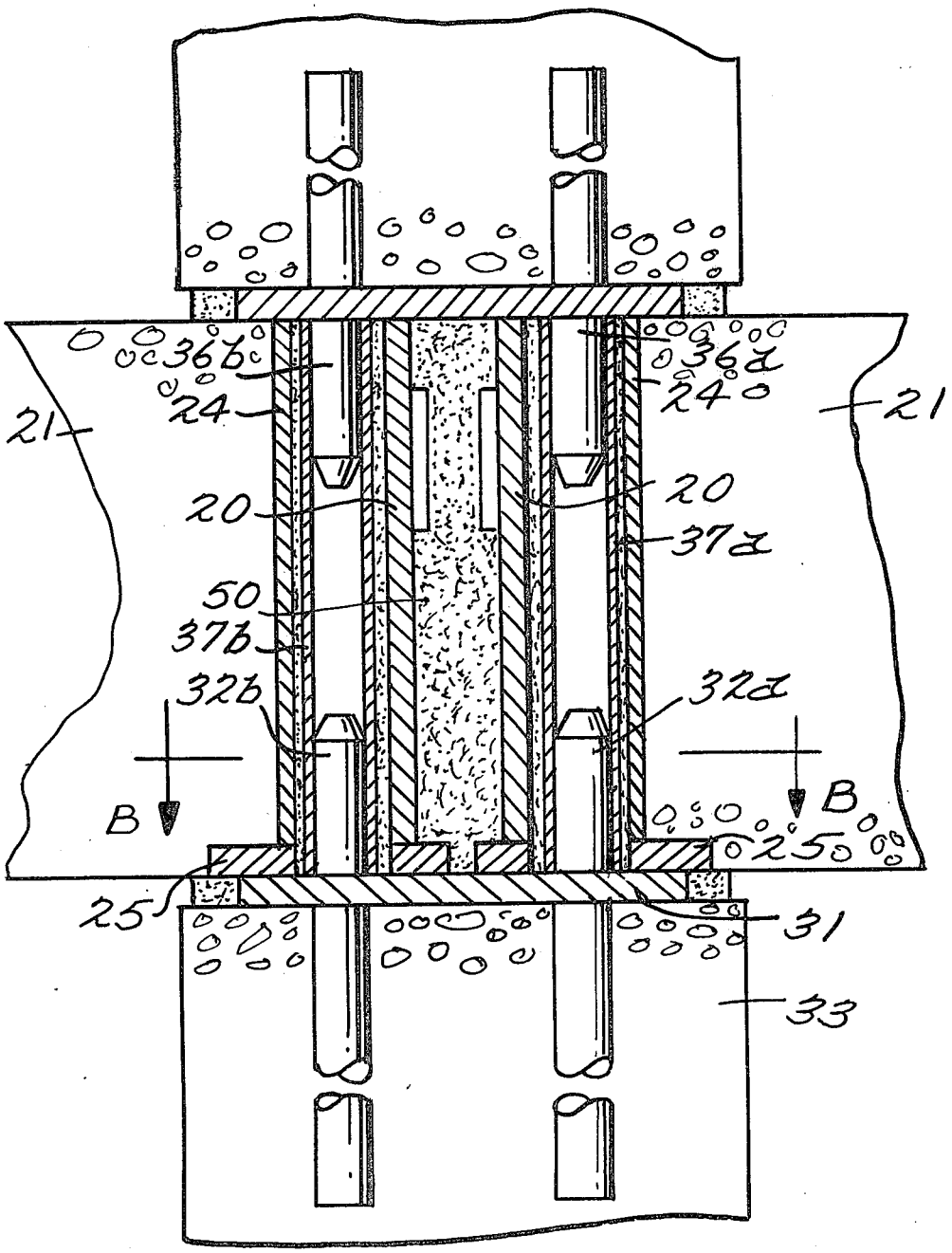
FIG. 5 is a section through two columns and two adjoining elements in the preferred embodiment.

FIG. 5 shows a section corresponding to FIG. 1. The wedged-in pins 32*a* and 32*b*, which are partly embedded in column 33, project through head plate 31. The situation is similar for the next column 34 with plate 35 and pins 36*a* and 36*b*. The reference numbers 20, 21 and 24 correspond with those in FIG. 3 and FIG. 4. FIG. 5 now also shows pipes 37*a* and 37*b*, which are used to centre column 34 correctly in relation to column 33, and which slide over the ends of pins 32*a* and 32*b*, and 36*a* and 36*b*, respectively. The space round pipes 37 between the angle irons and all of the empty space between elements 21 are filled with sand/cement mortar 50 or other hardening material. The heads of pipes 27 are covered over during this operation and the tubes are also fixed in relation to each other.

Figure 6:
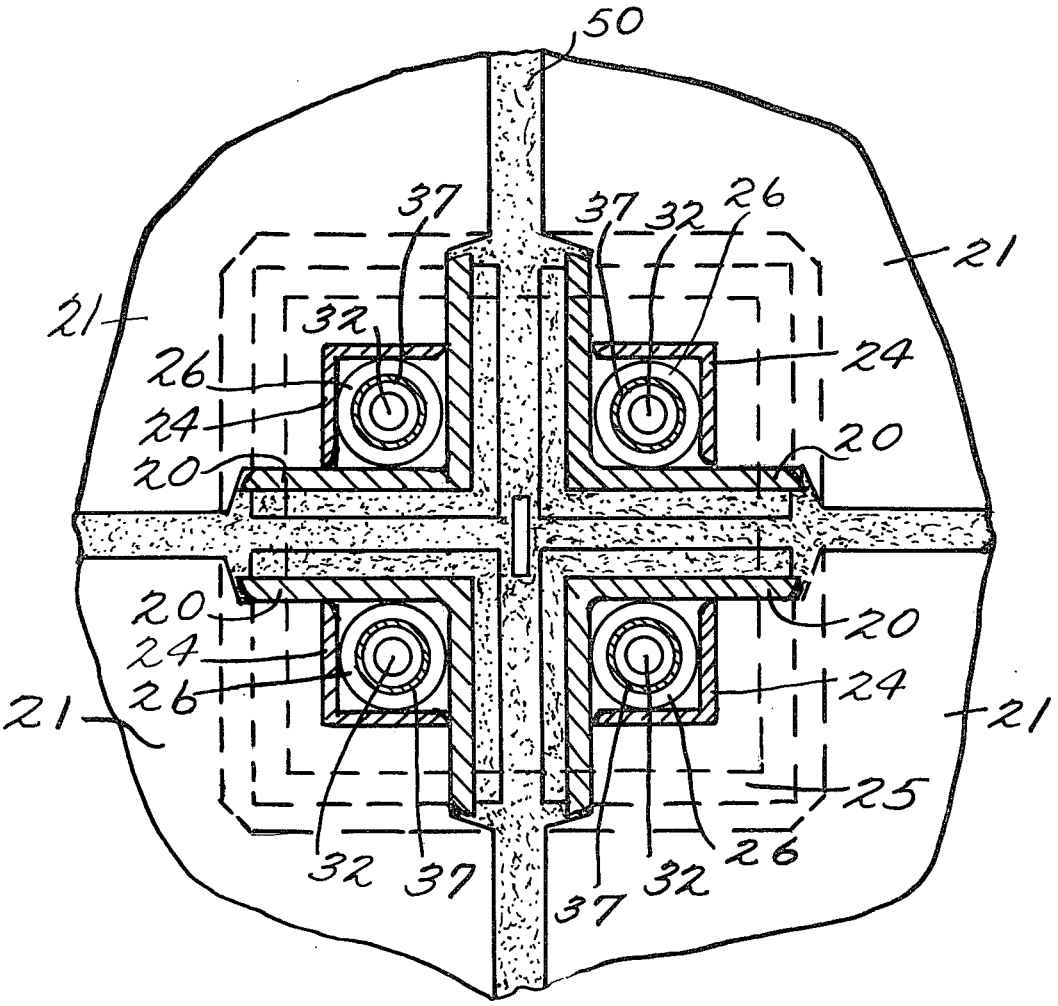
FIG. 6 is a section taken along the plane of line B—B in FIG. 5.

FIG. 6 shows a horizontal section through the preferred embodiment, taken along line B—B in FIG. 5.

Corresponding parts are indicated by corresponding reference numbers.

Figure 7:
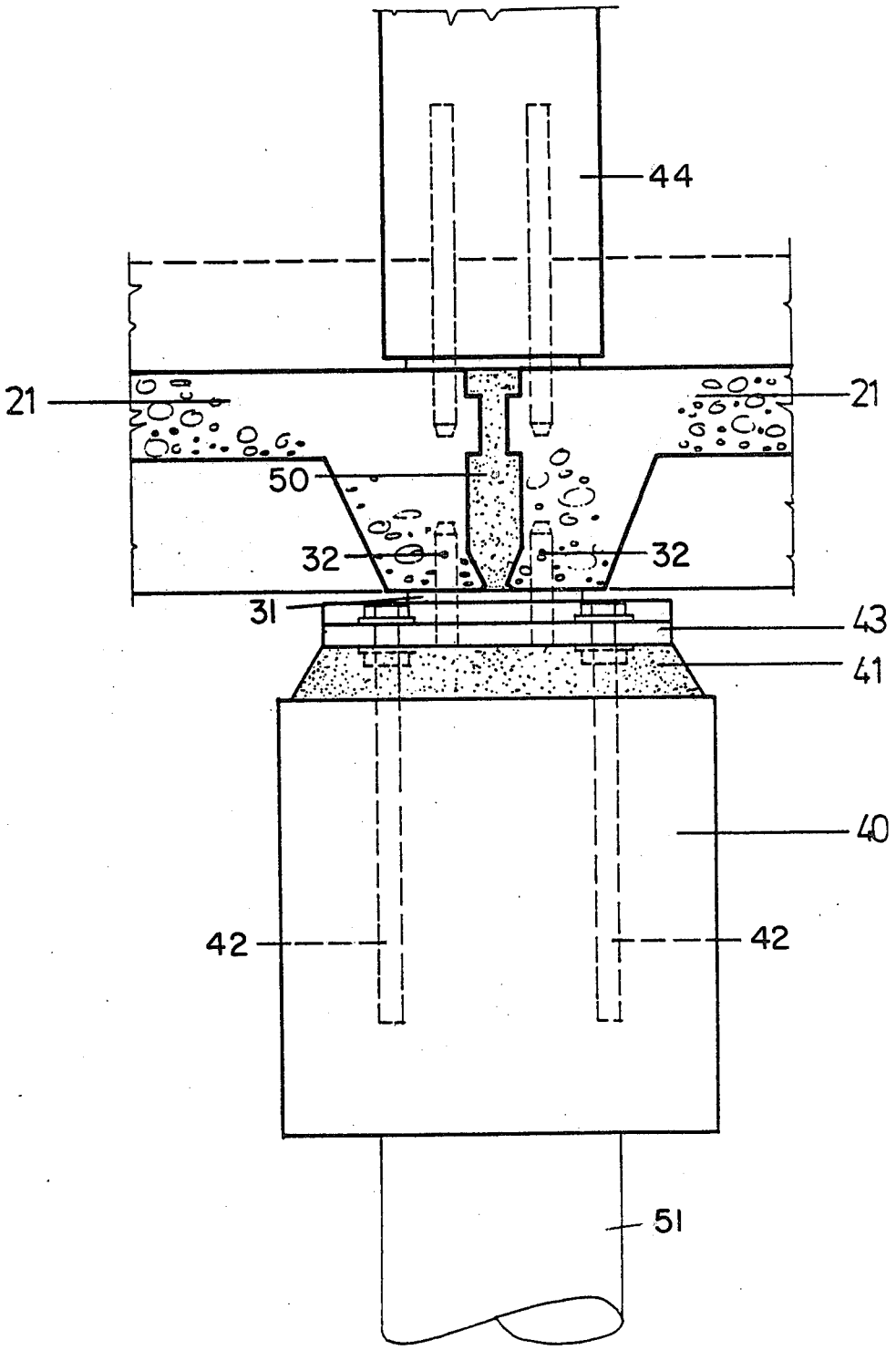
FIG. 7 is a section through the ground floor and the foundation.

FIG. 7 shows the connection with a foundation pile 51 or footing. Anchors 42 are embedded in a cast-concrete unit 40 and a subsequently introduced filling layer 41. On these is laid an adjustable plate 43, and on the latter plate 31, with the projecting rods 32. Elements 21 and column 44 are placed on top in the usual manner (shown only schematically).

The diagram does not show that the tubular sections can be provided with a hoisting hole at their free side, i.e. at the side not covered with concrete. It is therefore not necessary to embed special hoisting eyes.

Figure 8:
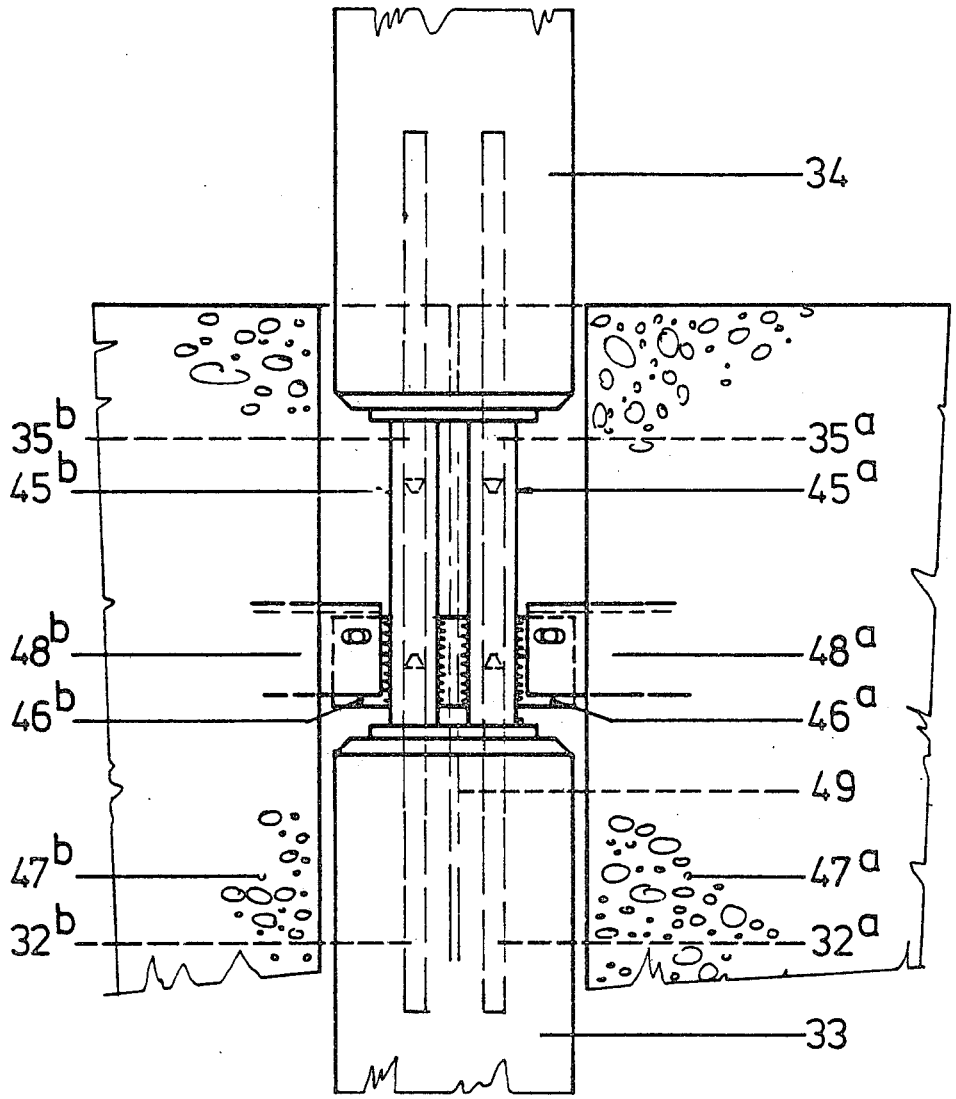
FIG. 8 shows the suspension of outside-wall elements in elevation.
Figure 9:
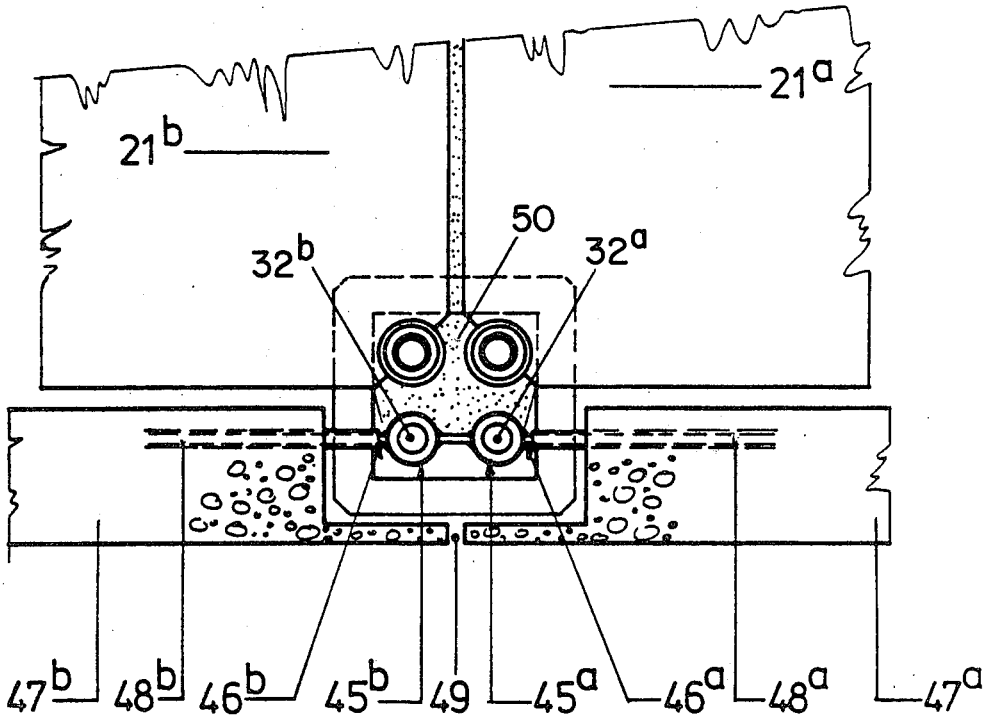
FIG. 9 shows the detail of FIG. 8 in top-view.

FIGS. 8 and 9 finally show by way of example, that the building structure here described in very suitable for the suspension of outside wall elements. Columns 33 and 34 are in this case joined to form a single rigid whole with two elements 21*a* and 21*b*, in the manner shown in FIG. 5 (these elements are shown only in FIG. 9). The unutilised bars 32*a* and 32*b*, and 35*a* and 35*b*, respectively, are now used for suspending, with the aid of slid-on interconnected pipes 45*a* and 45*b* with welded-on strips 46*a* and 46*b*, the wall elements 47*a* and 47*b* by means of strips 48*a* and 48*b* laterally incorporated in these elements on or near their tops. Corresponding strips are rigidly connected by means of bolts. Elements 47*a* and 47*b* will preferably grip the columns; joint 49 can be filled with a suitable material.

One form of embodiment was subjected to testing. The elements were concrete slabs measuring 2.40×7.20 m, with a thichness of 8 cm, and with ribs having a height of 12 cm at 60 cm centres, provided with prestressed reinforcement. The supports were formed by plates measuring 160×160×10 mm with four clamped-in rods of 20 mm diameter. The corners of the elements comprised a first angle iron measuring 80×80×10 mm, while the second angle iron measured 40×40×4 mm. The welded-on baseplates measured 85×85×10 mm; the hole corresponding to the circle inscribed between the angle irons had a diameter of 36 mm. The centring pipe had an inside diameter of 21 mm and thus fitted round the bars; its outside diameter was 25 mm so that a clearance of (36–25):2=5.5 mm remained which to correct dimensional deviations. The short side of the element was fitted with three pre-tensioning wires anchored to angle iron 20, the long side with four.

This supporting structure, as also illustrated in FIGS. 3 to 6 of this application, was tested by TNO Institute for Building Materials and Building Structures for the purpose of the previously mentioned practical application, under characteristic forces and loads occuring in practice. It could be concluded from the test results. No. B-78-426/62.6.0101, dated Dec. 11, 1978, that the supporting structure complied with the applicable standards.

In the construction of a building deviations in details will obviously be necessary. In so far as deviating constructional details are based on the essence of the invention, they are considered to form part of the invention.

The invention also relates to a steel structure for use in a building structure in accordance with the invention. This steel structure consists of:

a. a first angle iron (20) and a second angle iron (24) welded against the inside of the flanges thereof;

b. a steel head plate (31) with at least one bar (32) placed at right angles to it in such a position that when the connected angle irons (20 and 24) are placed over the bar (32), the first angle iron (20) occupies at most one quadrant of the head plate (31). More particularly, the steel structure is composed as follows:

a. a first angle iron (20) and a second angle iron (24) welded to the inside of the flanges thereof;

b. a baseplate (25) to which the angle irons (20 and 24) are fastened at right angles and which is provided with an opening which corresponds to the circle (26) inscribed between the angle irons (20 and 24);

c. a steel head plate (31) with at least one bar (32) placed at right angles to it in such a position that when the baseplate (25) is placed flat on the head plate (31), the base plate (25) occupies at most one quadrant of the head plate (31).

For the purpose anchoring prestressed reinforcement to the steel structure, the first angle iron (20) has, cut in it at the end of the flanges outside the second angle iron (24), holes for the passage of reinforcing bars (27 and 28).

Additionally, the first angle iron (20) is rigidly connected by both flanges to a loop-shaped reinforcing bar (30, 30*a*). Finally, the bars (32) project with a tight fit through an opening in the head plates (31). The thickness of the flanges of the first angle iron (20) and of the plates (12, 31 and 25) in the steel structure is at least 6 mm.

I claim:

1. A building structure having a frame, composed of prefabricated parts, comprising:

a plurality of slab-shaped floor or roof elements located one above the other;

a plurality of concrete support columns interconnecting the corners of said elements;

each column having a coverplate provided at the top end thereof and at least one bar having a given outside diameter projecting axially from the column top end;

at least one elongated tubular section having a predetermined inside diameter formed at each corner of each of said elements, and embedded within the element so that it extends at least to the top and bottom surfaces of the element;

said bars and tubular sections positioned with respect to each other and said elements and columns so that in the assembled condition a corner of an element covers approximately one quadrant of the head of a column, and the tubular sections transmit the weight of the elements to the columns and transmit the forces exerted by columns located in alignment with each other, with each bar received by a tubular section; and the ratio of the inside diameter of a tubular section to the outside diameter of a bar with which it is associated being from 3:2 to 5:2.

2. A building structure as claimed in claim 1 wherein:

the coverplates are steel and have holes which fit tightly around the protruding bars, and the bars are embedded in the columns;

the tubular sections at the corners of the elements are composed of: a first angle iron, which forms the corner and does not project beyond imaginary extensions of the edges of the element; and a second angle iron, which is welded against the inside of the first angle iron so that a tubular opening is created, the diameter of whose inscribed circle forms said predetermined inside diameter of that tubular section; and the edges of the elements are reinforced with prestressed bars, said prestressed bars being fastened by nut connections to the first angle iron.

3. A building structure as claimed in claim 2, characterized in that;

the tubular section is fitted at the side thereof which forms the bottom of the element with a rectangular baseplate having dimensions that are at least equal to those of the flanges of the first angle iron and which has an aperture corresponding to the circle inscribed between the first and second angle irons;

and the combined height of the tubular section and the baseplate at a corner is at least equal to the thickness of the elements at that corner.

4. A building structure as claimed in claim 2, characterized in that the first angle irons are connected to by pretensioned bars.

5. A building structure as claimed in claim 2, characterized in that the first angle irons cooperate with curved reinforcing bars rigidly fixed thereto.

6. A building structure as claimed in claim 5, characterized in that the reinforcing bars form a loop.

7. A building structure as claimed in claim 1, characterized in that the bottom element (21) rests on a pile head or footing on which is fitted an adjustable accessory provided with the necessary number of protruding bars (32) and a plate (31), fastened to an embedded baseplate (43).

8. A building structure as claimed in claim 1, characterized in that two or more columns are replaced by a plate, with bars or pins with support slabs projecting from the top and bottom of the plate at the required spacings corresponding to the column spacings.

9. A building structure as claimed in claim 1 further comprising outside wall elements are suspended on non-utilised bars on outside wall columns and the associated coverplates.

10. A building structure as claimed in claim 9, characterized in that the non-utilized bars carry, with the aid of slid-on interconnected pipes with welded-on strips, outside-wall elements by means of strips laterally incorporated in these elements at or near their tops, corresponding strips being rigidly connected.

11. A building structure as claimed in claim 1, characterized in that the concrete support columns have a cross-sectional area of at least approximately 20×20 cm.

12. A building structure as claimed in claim 1 further comprising a tube which fits around each bar, said tube being enclosed in a respective tubular section and having a clearance relative to its respective tubular section.

13. A building structure as recited in claim 1 further comprising a hardening compound disposed in the annular area between said tubular sections and bars, and disposed between the edges of adjacent abutting elements.

14. A building structure as claimed in claim 13, characterized in that the tubular sections have a hoisting hole cut in them on their free side.

15. A steel structure for application in a building structure comprising a plurality of slab-shaped floor or roof elements located one above the other with concrete support columns interconnecting the corners of the elements, said steel structure associated with a said element and column at the area of support therebetween and comprising:

a first angle iron;

a second angle iron welded against the inside of the flanges of the first angle iron;

a steel coverplate having at least one bar extending therefrom at a right angle thereto; and said angle irons and steel plate and bar being dimensioned and positioned so that when said first and second connected angle irons are disposed over said bar, said first angle iron at most occupies one quadrant of said coverplate.

16. A steel structure for application in a building structure comprising a plurality of slab-shaped floor or roof elements located one above the other with concrete support columns interconnecting the corners of the elements, said steel structure associated with a said element and column at the area of support therebetween and comprising:

a first angle iron;

a second angle iron welded to the inside of the flanges of the first angle iron, the angle irons defining an inscribed circle;

a baseplate fastened to said angle irons with said angle irons at right angles to said baseplate, an opening being provided in said baseplate substantially coextensive with the inscribed circle between said angle irons;

a steel coverplate having at least one bar extending therefrom at a right angle thereto; and said angle irons, baseplate, coverplate, and bar being dimensioned and positioned with respect to each other so that when said baseplate is placed flat on said coverplate said baseplate at most occupies one quadrant of said coverplate.

17. A steel structure as claimed in claim 16, characterized in that the thickness of the flanges of the first angle iron and of the plates is at least 6 mm.

18. A steel structure as recited in claims 15 or 16 wherein each bar projects with a tight fit through an opening in the coverplate with which it is associated.

19. A steel structure as claimed in claims 15 or 16, characterized in that the first angle iron has, cut in it at the ends of the flanges outside the second angle iron, holes for the passage of reinforcing bars.

20. A steel structure as claimed in claims 15 or 16, characterized in that the first angle iron is rigidly connected by both flanges to a loop-shaped rinforcing bar.

* * * * *